US006158515A

United States Patent [19]

Greer et al.

[11] Patent Number: 6,158,515

[45] Date of Patent: Dec. 12, 2000

[54] ARTIFICIAL LIFTING DEVICE FOR WELL FLUIDS USING A CONTINOUS LOOP

[75] Inventors: Richard H. Greer, Hawkins; Herbert W. Markwardt, Arlington; Stephen B. Markwardt, Fort Worth; Walter R. Shaw, Alvarado; John R. Watson, Weatherford, all of Tex.

[73] Assignee: Lift Systems LLC, Fort Worth, Tex.

[21] Appl. No.: 09/018,719

[22] Filed: Feb. 4, 1998

[51] Int. Cl.[7] ..... E21B 43/08

[52] U.S. Cl. ..... 166/369; 166/67

[58] Field of Search ..... 166/369, 68, 67, 166/75.11, 105

[56] References Cited

U.S. PATENT DOCUMENTS

| | | | |
|---|---|---|---|
| 831,448 | 9/1906 | Leinweber . | |
| 1,703,963 | 3/1929 | Scruby . | |
| 2,329,913 | 9/1943 | Kizziar . | |
| 3,774,685 | 11/1973 | Rhodes | 166/314 |
| 4,712,667 | 12/1987 | Jackson et al. | 198/643 |
| 4,962,847 | 10/1990 | Pisors et al. | 198/643 |
| 5,016,708 | 5/1991 | Baer et al. | 166/75.1 |
| 5,048,670 | 9/1991 | Crafton et al. | 198/643 |
| 5,080,781 | 1/1992 | Evins, IV | 210/112 |
| 5,223,128 | 6/1993 | Combrowski | 210/138 |
| 5,381,861 | 1/1995 | Crafton et al. | 166/77 |

*Primary Examiner*—David Bagnell
*Assistant Examiner*—Zakiya Walker
*Attorney, Agent, or Firm*—Geoffrey A. Mantooth

[57] ABSTRACT

Fluid is lifted from a well with a continuous loop of fibrous material, such as rope. The rope loop is formed around a drive sheave on the surface with a return sheave down inside of the well. The drive sheave has ridges along the side surfaces of a groove. The rope lays in the groove in contact with the ridges. A motor rotates the drive sheave so as to lift the oily rope from the well. Guides and wipers are provided to direct the rope into the drive sheave and to the wipers. The wipers are slotted cards that scrape a quantity of oil from the outside surface of the rope. The oil falls down into a bottom of a housing for collection purposes.

22 Claims, 8 Drawing Sheets

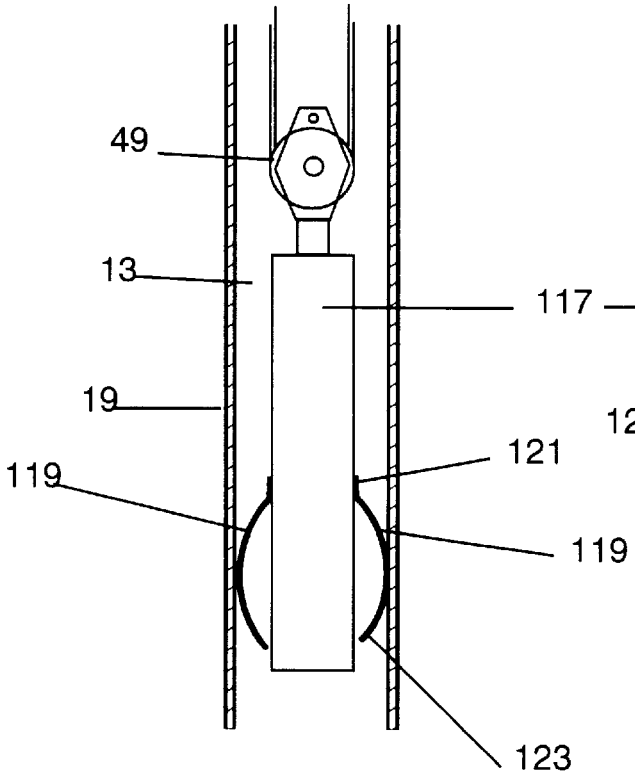
Figure 10
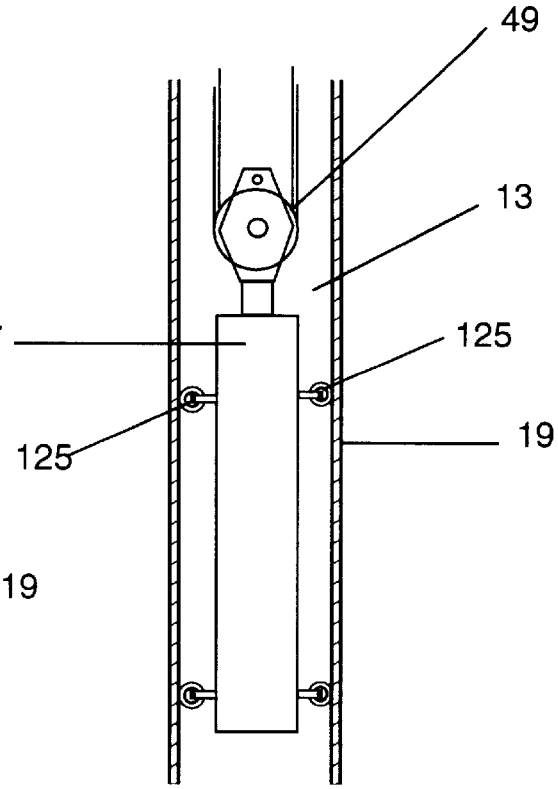
Figure 11
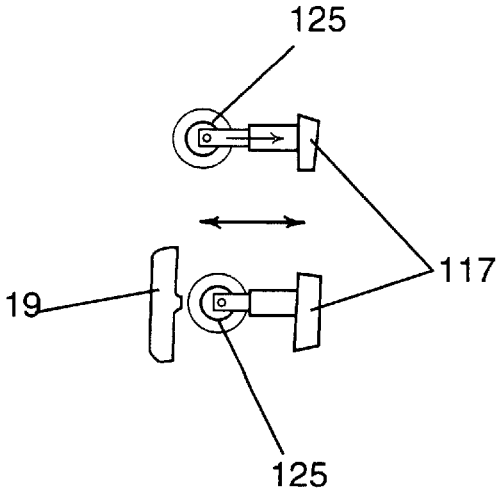
Figure 12A
Figure 12B

ARTIFICIAL LIFTING DEVICE FOR WELL FLUIDS USING A CONTINOUS LOOP

SPECIFICATION

1. Field of the Invention

The present invention relates to artificial lifting devices that utilize a continuous loop of material such as rope, which lifting devices are used to lift liquids such as oil from wells.

2. Background of the Invention

Extracting oil from a well can occur several ways. Preferably, the oil is under sufficient pressure to flow to the surface of the earth on its own accord. However, many wells, and especially older wells, lack such a pressure. Therefore, the oil must be artificially lifted to the surface.

A common technique involves the use of a pump jack, sucker rods and a bottom hole pump. The rods extend from the surface down into the oil inside of the well. A prime mover, either electric or internal combustion, reciprocates the rods up and down in a pumping action.

The problem with these types of pumps is that many wells are relatively deep. Consequently, the length of the pumping rods extending into the well is great. Stripper wells typically produce less than 10 barrels of oil a day. Many stripper wells only produce 2–3 barrels per day. In such a low volume well, the installation of pumping rods is too expensive. As a result, wells have to be abandoned, not because of a lack of productivity, but because of economics.

The irony is that abandoning a well is also expensive. In the state of Texas, an abandoned well must be plugged, at a cost of several thousand dollars.

Therefore, what is needed is an inexpensive method and apparatus for lifting oil from a well.

SUMMARY OF THE INVENTION

It is an object of the present invention to provide a low cost method and apparatus for producing or lifting oil from a well.

The apparatus of the present invention lifts fluid from a well and includes a continuous loop of fibrous material, a drive sheave, a motor, a return sheave, at least one fluid remover, and a container. The loop of fibrous material is formed around the drive sheave and the return sheave. The drive sheave has a groove with inside surfaces that contact the fibrous material. The inside surfaces are formed by ridges which are separated from one another by valleys, with the ridges extending from an outside diameter of the drive sheave towards a center of the drive sheave. At least some of the ridges from each inside surface contact a portion of the fibrous material The return sheave is structured and arranged to be located inside of a well. The motor is coupled to the drive sheave so as to rotate the drive sheave. The fluid remover is located in contact with the loop so as to remove oil therefrom. The container is positioned so as to capture any fluid that is removed from the loop by the remover.

In one aspect of the present invention, the fibrous material is capable of maintaining a generally circular transverse cross-sectional shape and is capable of taking up a quantity of oil.

In one aspect of the present invention, the loop includes a rope made of plastic material. In another aspect of the present invention, the rope comprises a double braid.

In still another aspect of the present invention, the ridges of the drive sheave are angled with respect to a radius of the drive sheave. The portion of each ridge at the outside diameter of the drive sheave leads the remainder of the respective ridge relative to the direction of rotation of the drive sheave. This eases the release of the fibrous material at the release point.

In accordance with another aspect of the present invention, the drive sheave comprises two transverse portions and at least one spacer that is interposed between the two portions. The groove is sized so as to be smaller in width than the outside diameter of a transverse cross-section of the loop.

In still another aspect of the present invention, the width of the groove tapers from the outside diameter toward the center of the drive sheave.

The apparatus of the present invention lifts fluid from a well and includes a continuous loop of fibrous material, a drive wheel, a return sheave, a motor, a wiper card, and a container. The continuous loop of fibrous material is formed around the drive wheel and the return sheave. The return sheave is structured and arranged to be located inside of a well. The card has a slot therein. The card is mounted stationary with respect the fibrous material. The slot receives a portion of the fibrous material and has edges that bear against an outside surface of the fibrous material. The container is positioned so as to capture any fluid that is removed from the fibrous material by the card.

In one aspect of the present invention, the apparatus includes plural wiper cards, with each of the cards being spaced apart from each other longitudinally along a length of the fibrous material. In addition, each of the cards contacts a different circumferential portion of the fibrous material.

In still another aspect of the present invention, the apparatus includes a means for forcing the slot edges of the wiper card against the fibrous material. In still another aspect of the present invention, the means for forcing the slot edges of the wiper cards against the fibrous material include a spring.

A method of the present invention lifts oil from a well. A length of fibrous material is located in the well so as to make contact with the oil. The fibrous material is pulled up out of the well using a sheave with a groove having scalloped inside surfaces. The oil is removed from the fibrous material and the fibrous material is returned to the well.

In one aspect of the method of the present invention, the step of locating a length of fibrous material further comprises providing the fibrous material in a continuous loop around the sheave.

In another aspect of the present invention, the oil is wiped from the outer surface of the fibrous material, which can be rope.

BRIEF DESCRIPTION OF THE DRAWINGS

FIG. 10 is a view of the downhole sheave assembly in accordance with another embodiment.

FIG. 11 is a view of the downhole sheave assembly, in accordance with still another embodiment.

FIGS. 12A and 12B are detail views of the spring loaded rollers of FIG. 11.

DESCRIPTION OF THE PREFERRED EMBODIMENTS

Figure 1:
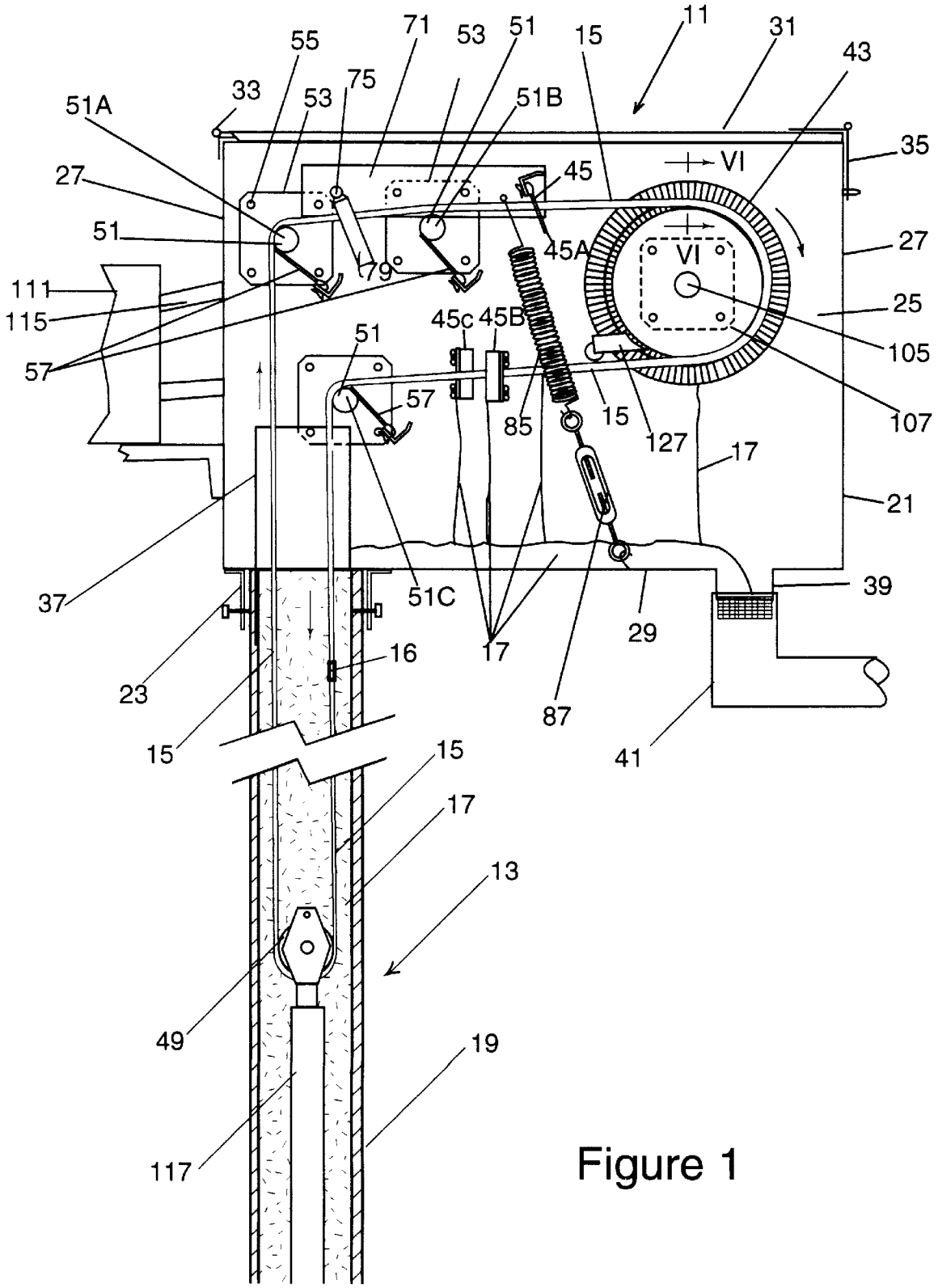
FIG. 1 is a schematic cross-sectional view of an oil well on which the lifting apparatus of the present invention, in accordance with a preferred embodiment, has been installed.
Figure 2:
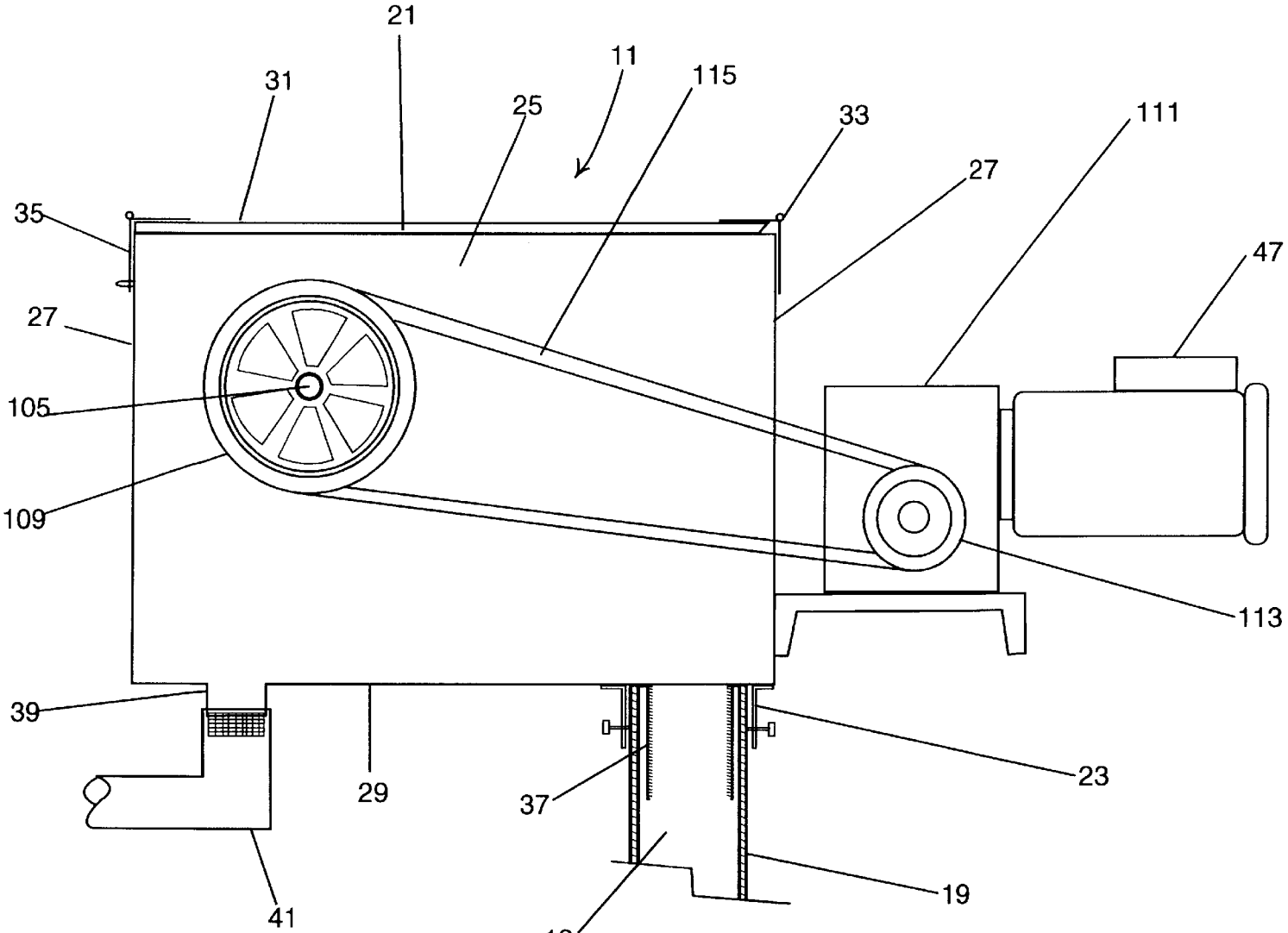
FIG. 2 is a back side view of the apparatus, showing the motor and a speed reducer.

In FIGS. 1 and 2, there is shown the lifting apparatus 11 of the present invention, in accordance with a preferred embodiment. The apparatus is shown as installed on an oil well 13. A continuous loop of rope 15 extends into and out of the well 13. At the bottom of the loop, the rope 15 makes contact with the oil 17. The rope takes up a quantity of oil. The rope is then pulled to the surface, where at least some of the oil is removed. The rope is then returned down to the oil inside of the well. This process of lifting the rope, cleaning it of oil, and returning the rope to the well, operates continuously as the rope is moved along the loop. In this manner, oil is brought to the surface.

The well 13 is a typical oil well. It has casing 19 that extends down into the ground. The casing penetrates a production zone of the earth, wherein oil fills at least a portion of the casing. The casing may be provided with tubing of a sufficient diameter, wherein the rope is disposed inside of the tubing, instead of the casing.

The lifting apparatus 11 has a housing 21. The housing 21 is mounted to the top end of the casing 19 by a collar 23. The housing 21 is a box-like container, having side walls 25, end walls 27 that extend between the side walls, a bottom wall 29, and a top wall 31 in the form of a lid. The lid 31 is hinged 33 to an end wall 27. A hasp 35 can be provided on the lid 31 to secure the contents of the housing.

The housing 21 forms a fluid tight container. Oil 17 that is removed from the rope 15 drips or flows down toward the bottom wall 29. The bottom wall is sealed around an inner collar 37, which extends up through the bottom wall for some distance. The inner collar 37 also extends down into the casing. The rope 15 extends into the well 13 via the inner collar 37. The bottom of the housing thus forms a storage compartment for the oil. A drain 39 can be provided in the bottom wall 29. A pipe 41 is connected to the drain 39, to convey the collected oil to a desired destination.

The lifting apparatus 11 includes the rope 15, a drive sheave 43, oil removers 45, a motor 47, and a return sheave 49.

The rope 15 serves as the media for holding the oil and lifting it up out of the well for recovery. In the preferred embodiment, the rope is double braided polyester. Such a rope comprises an inner core of polyester fibers, and an outer jacket of polyester fibers. The outer jacket is separate from the inner core. A single braid polyester rope could be used. However, a double braid polyester rope provides several advantages over a single braid. First, the double braid configuration provides more reliability. If the cuter jacket of the rope chafes or wears, the inner core is able to keep the rope from breaking. Inspection of the rope from time to time is used to identify any wearing or chafing of the rope. Second, a double braid polyester rope maintains its round cross-sectional shape fairly well when being pulled by the drive sheave. It resists flattening, therefore allowing the drive sheave 43 to obtain a grip or purchase on the rope. Even as the rope is stretched out, it maintains its shape. The rope is conventional and commercially available.

The braid can be a twist braid or a diamond braid or some other type of braid. It is believed that a diamond braid eliminates the tendency for the rope to twist while in the well. The outer jacket can be lock stitched to the inner core to prevent the inner core from twisting relative to the outer jacket.

Other types of rope could also work satisfactorily. For example, the rope could be some type of polyester rope. Polyester repels water and has an affinity for oil. Polyester may be oleophilic. Other materials may also work, such as polypropylene. Other braids could also be used. The lifting media could also be metal, cable, or chain. However, metal, cable, or chain can be heavy and potentially costly.

The rope 15 is formed into a continuous loop. Therefore, the two ends of the rope are spliced to each other. The splice 16 is a low profile type, so as to minimize any increase in its outside diameter of the rope. The splice minimizes the tensile strength of the rope by an insignificant amount. The rope is sufficiently long so as to extend from the housing into the well, where the rope comes into contact with the oil. The bottom of the rope loop should be immersed in the oil.

As the rope 15 exits the casing 19, it enters the housing 21. Several guides 51 are used to direct the rope to the drive sheave 43 and through a series of removers 45. The drive sheave 43 lifts the oil laden rope out of the well and returns clean rope down into the well. The removers 45 remove the oil from the rope for collection and transport.

The guides are metal rods 51 (see FIG. 1) rotatably mounted to the housing. The ends of each rod are mounted in flanged pillow blocks 53, which in turn are mounted to the side walls 25 of the housing 21 by bolts 55. As the rope exits the well, it encounters a first roller guide 51A, wherein the rope changes direction from vertical to near horizontal. The rope passes over a second roller guide 51B before entering the drive sheave 43. As the rope exits the drive sheave, also at a near horizontal orientation, the rope passes over a third roller guide 51C, wherein the rope changes back to vertical for a descent into the well. In the preferred embodiment, the rollers are 1–1½ inches in diameter. The number and placement of the roller guides 51 are typically dictated by the location of the drive sheave 43 relative to the well head and the size of the apparatus 11.

Figure 3:
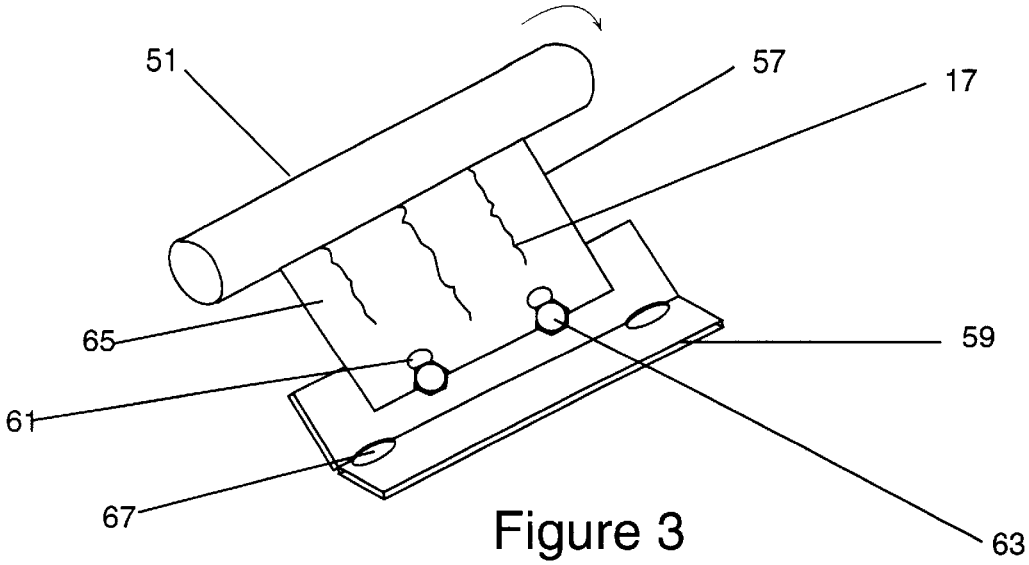
FIG. 3 is an isometric view of one of the roller guides, together with a scraper blade.

Each roller guide 51A, 51B, 51C removes some of the oil from the rope. Consequently, scrapers 57 are provided on each roller guide in order to clean the rollers. Referring to FIG. 3, a scraper blade arrangement is shown. The ends of the roller 51, as mounted in the pillow blocks, are not shown in FIG. 3. The scraper blade arrangement is typical to all of the roller guides.

The scraper blade 57 is held in position by an angle bracket 59. The bracket 59 extends between, and is mounted to, the two housing side walls 25 (see FIG. 1). The ends of the bracket can be mounted to the side walls by welding or by way of a fitting. The blade 57 has slots 61 formed along one edge. The slots are used to secure the blade to the bracket; the slots receive bolts 63. The other, or free, end 65 of the blade is positioned to contact that portion of the roller 51 that is unobstructed by the rope. The slots 61 allow the blade to be moved closer to, or away from, the roller 51. The blade 57 can be bent or curved when positioned against the roller 51. This applies a resilient or spring force of the blade against the roller 51, and maintains contact between the blade and the roller even after the blade has experienced some wear.

As the roller 51 rotates, oil 17 that is on the roller is scraped off by the scraper blade. The oil is pulled by gravity down the blade, where it flows into the bracket 59. The bracket 59 has holes 67 therein, through which holes the oil escapes into the bottom of the housing. The holes 67 are located near the side walls of the housing so that the oil draining out will avoid any rope below.

In the preferred embodiment, the scraper blade 57 is made of a plastic, such as polycarbonate, polyethylene, high density polyethylene (HDPE), or phenolic.

Figure 4:
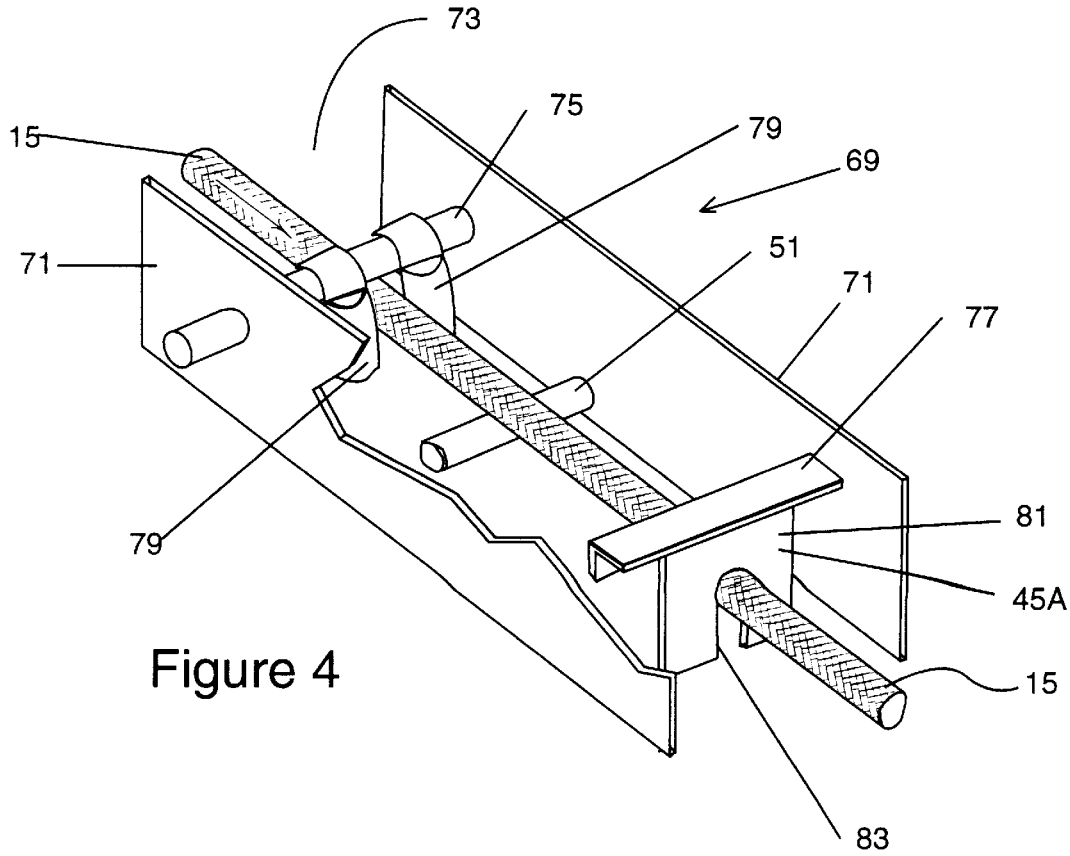
FIG. 4 is an isomeric view of the finger guide and first wiper assembly.

FIGS. 1 and 4 show a finger guide and wiper assembly 69. The rope 15 passes through this assembly before entering the drive sheave 43. The assembly has two side plates 71 that are parallel to each other and are separated from each other by a gap 73. The plates 71 are coupled together by a rod 75 and a bracket 77. The rod 75 extends into the side walls 25 of the housing 21, wherein the side plates 71 are pivotally mounted to the housing 21. The end of the side plates containing the bracket 77 can swing up and down with respect to the bottom wall 29 of the housing (see FIG. 1).

Two finger guides 79 depend from the rod 75 at a location that is between the side plates 71. The finger guides 79, which are cylinders, are spaced apart from each other. The rope 15 passes between the two finger guides 79. The finger guides keep the rope centered between the side walls 25 of the housing, for proper feeding through the first wiper 45A and into the drive sheave 43.

In the preferred embodiment, the oil removers 45 are wipers. Each of the wipers 45 is a card or blade of plastic substantially similar to the scraper blades. One end of the wiper is mounted to a bracket (such as the bracket 77 shown in FIG. 4) using bolts. Slots can be provided in the end to allow adjustment of the card position relative to the rope. The other, or working, end of the wiper has a "U" shaped slot 83 therein. The slot 83 receives the rope 15. The width of the slot 83 is about the same as the outside diameter of the rope 15. As the rope passes through the slot, the oil is scraped off the outer surface of the rope by the wiper blade 45. The oil 17 flows down to the bottom of the housing. The wiper is angled so as to contact the rope 15 at a downstream position of the wiper mount.

As the wiper blade is broken in by passing a length of rope through the slot, the shape of the slot conforms to the shape of the rope so that the wiper contacts about 180 degrees of the outer circumference of the rope. The wiper blades can be replaced from time to time.

Figure 5:
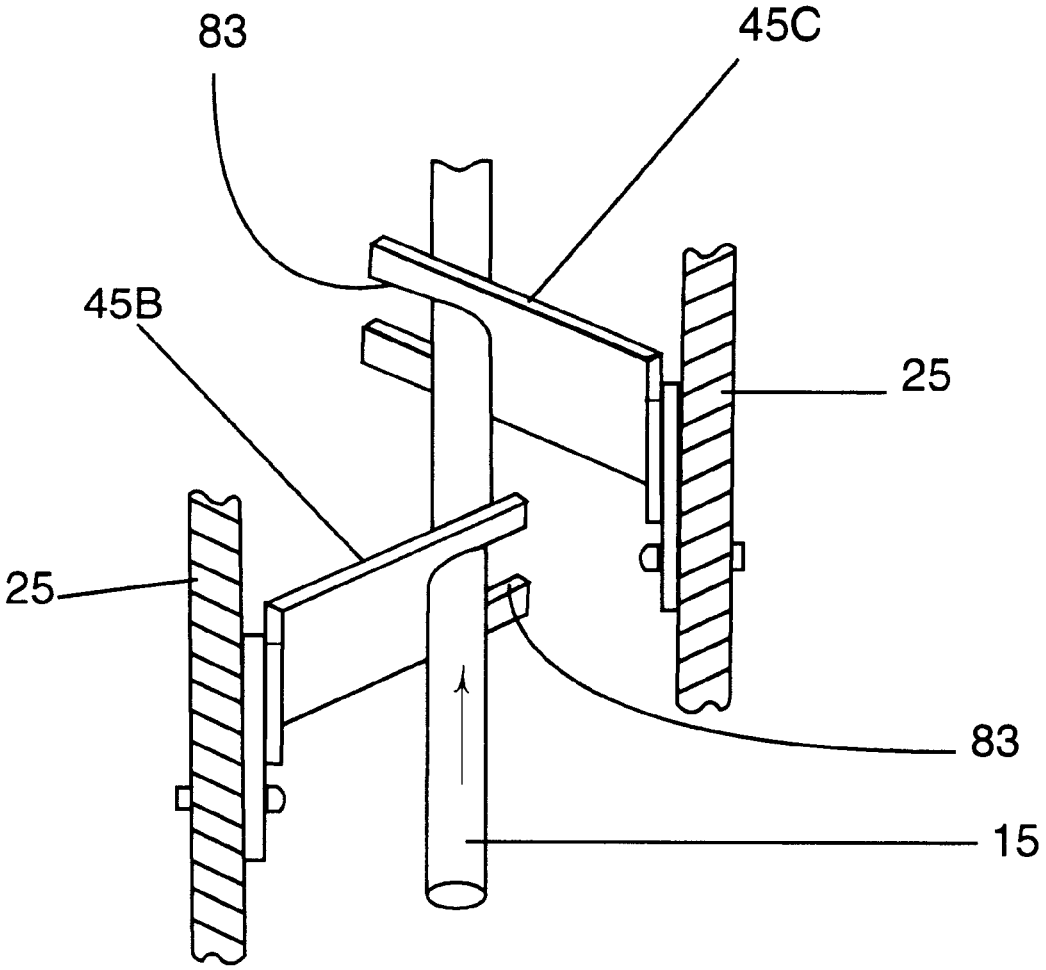
FIG. 5 is an isometric view, taken along the top of the rope as it exits the drive sheave, showing the second and third wipers.

The first wiper 45A is oriented so as to contact the top half of the rope, as it enters the drive sheave 43 (see FIG. 1). Referring to FIGS. 1 and 5, the second and third wipers 45B, 45C are positioned downstream of the drive sheave 43 and are oriented so as to contact the side halves of the rope.

Figure 13:
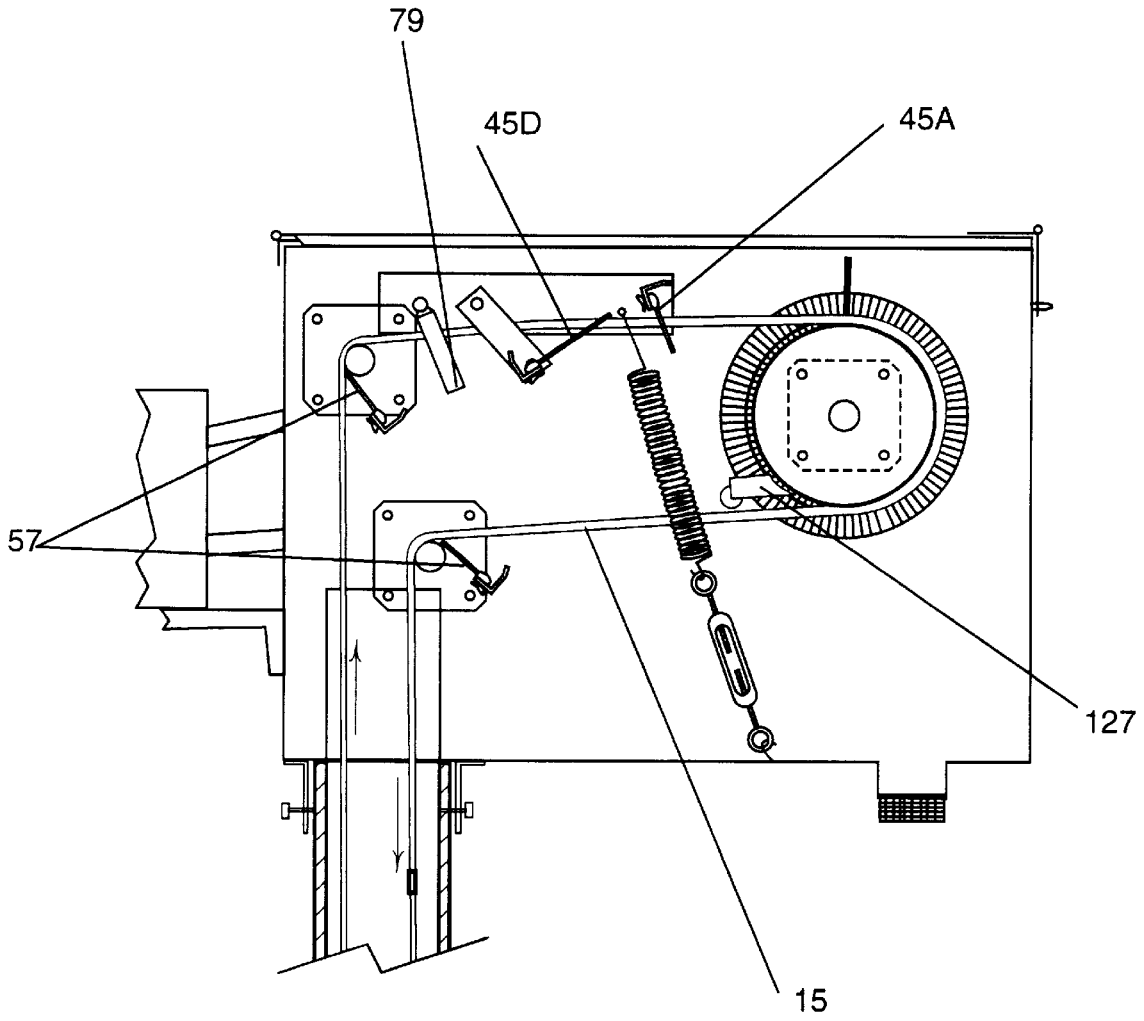
FIG. 13 is a schematic interior view of the lifting apparatus, in accordance with a preferred embodiment.

The wipers can all be positioned upstream or downstream of the drive sheave. In addition, more (or less) wipers can be used to remove oil from the rope. As an alternate embodiment, the second and third wiper blades can be replaced by a single wiper blade 45D that contacts the side of the rope not contacted by the first wiper (see FIG. 13). In FIG. 13, one of the rollers SiB has been removed. The rope is supported by the wiper blade 45D.

The wipers do not remove all of the oil from the rope, but they do remove a satisfactory amount. After the rope passes through the wipers, it can take on more oil downhole in the well. In addition to the wipers, various other types of oil removers can be used. For example, the rope could be pulled through wringers.

The wiper blades 81 are kept tensioned against the rope 15. The first wiper 45A is pulled down onto the rope by a coil spring 85 (see FIG. 1) that extends from one of the side plates 71 to the bottom wall 29 of the housing. The spring tension can be adjusted by a turnbuckle 87. The second and third wipers 45B, 45C are tensioned against the rope by angling the blades into the rope. The blades have some resiliency that allows them to be bent. The bent blades act as a spring to force the blade against the rope. Thus, as the slot enlarges due to wear, the blades continue to make contact with the rope. The wiper blades can also be tensioned against the rope by weight or counterweight.

Figure 6:
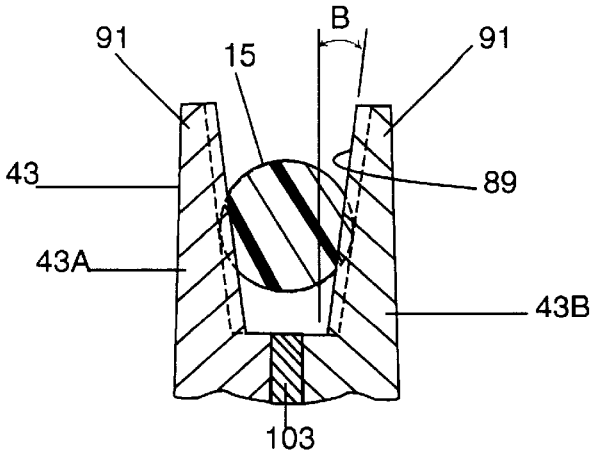
FIG. 6 is a transverse cross-sectional view of a portion of the drive sheave, taken along lines VI—VI of FIG. 1.

The drive sheave 43 will now be described. The drive sheave 43 has a generally "V" shaped groove 89 when viewed in longitudinal cross-section, as shown in FIG. 6. The groove 89 has two side walls 91. Each side wall has a textured inside surface in order to obtain a better grip on the rope. When the rope is oily, it becomes slick. Consequently, pulling the rope becomes difficult.

Figure 7:
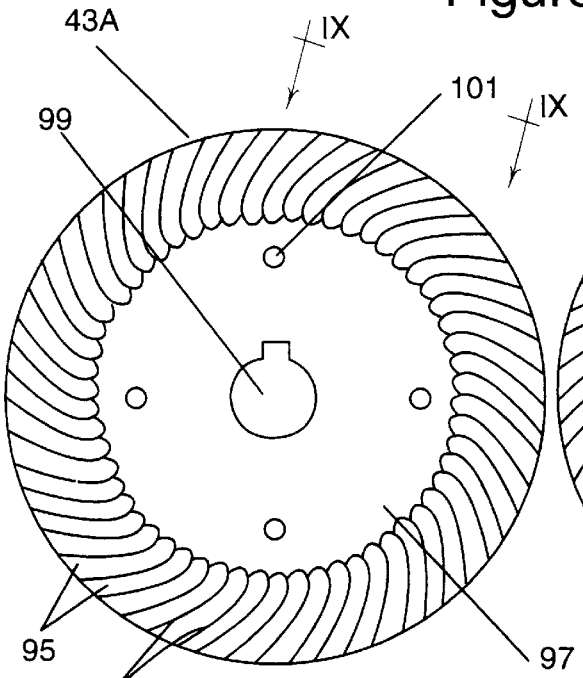
FIG. 7 is a plan view of one portion of the drive sheave.
Figure 8:
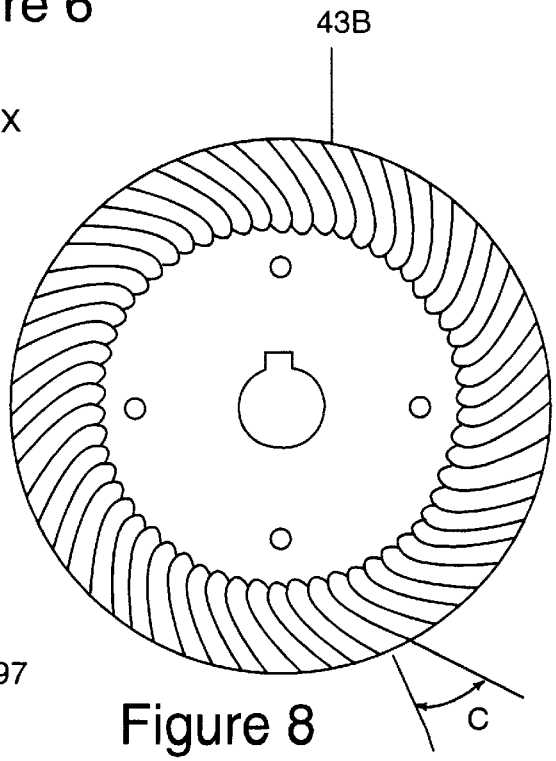
FIG. 8 is a plan view of the other portion of the drive sheave.
Figure 9:
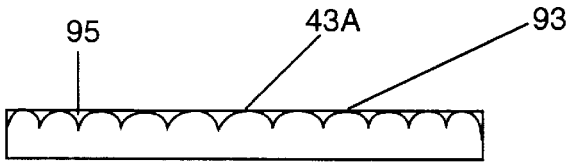
FIG. 9 is an edge view of one of the drive sheave portions, taken along lines IX—IX of FIG. 7.

In the preferred embodiment, the texturing of the side walls of the groove is formed by radially extending ridges 93. The ridges 93 are separated from one another by valleys 95. The ridges extend from a hub 97 outwardly to the outer diameter of the sheave 43. FIGS. 7 and 8 show the ridges in plan view, while FIG. 9 shows an edge view of the ridges. The individual ridges 93 are somewhat rounded where contact is made with the rope. The ridges can be made less rounded (sharper) so as to obtain a better grip on the rope. However, it is desirable that the ridges not damage the rope.

As shown in FIGS. 6–8, the drive sheave 43 is made up of two portions 43A, 43B with the groove being split down its center by the junction of the two halves. Therefore, each portion has a set of ridges 93. In the preferred embodiment, there are provided 72 ridges on each portion, with the ridges being spaced 5 degrees apart. The angle B that the side wall 91 makes with a plane that is transverse to the axis of rotation of the drive sheave 43 is 7½ degrees (see FIG. 6). Other embodiments could utilize a different number of ridges, at a different spacing and with a different angle B.

Also, in the preferred embodiment, the ridges are angled C with respect to a radius of the sheave. As shown in FIGS. 7 and 8, in the preferred embodiment the ridges are angled between 50–60 degrees from a radius. The sheave portion of FIG. 7 has ridges that are angled clockwise, while the sheave portion of FIG. 8 has ridges that are angled counterclockwise. Thus, when the two ridge portions are assembled together, the ridges all extend from the hub to the outside sheave diameter in a downstream direction (see FIG. 1).

The sheave portions are machined by using a grooving tool from the outside edge to the hub. The tool is run into the hub on an upward slope so as to form the inclined wall on the groove. If the grooves are spaced close together, the ridges may have some sharp edges. These edges can be machined smoother to minimize damage to the rope.

The hub 97 of each sheave portion has a flat surface for contacting the hub of the other sheave portion. Each hub has a center hole 99 for receiving a keyed drive shaft, and holes 101 for receiving bolts. The two sheave portions are bolted together.

The width of the groove 89 at the outside diameter of the drive sheave is sized so as to be about equal to the outside diameter of the rope. The ridges of both sides of the groove contact the rope. As the rope is moved down into the groove, it becomes wedged therein. The width of the groove can be varied to accommodate different diameters of rope by inserting one or more spacer discs 103 (see FIG. 6) between the two sheave portions 43A, 43B.

The drive sheave 43 is mounted to the drive shaft 105. The drive shaft 105 is in turn rotatably mounted to the side walls 25 of the housing 21. The drive shaft 105 is supported by pillow blocks 107 on the housing side walls. One end of the drive shaft 105 extends outside of the housing, as shown in FIG. 2. A conventional sheave 109 is coupled to this outside end of the drive shaft.

The drive sheave 43 is rotated by the motor 47 (see FIG. 2). The motor 47 can be of the electric, internal combustion, or other type. The motor is coupled to a transmission or speed reducer 111. The transmission is coupled to the sheave 109 by way of another sheave 113 and a belt 115. The motor can be directly coupled to the drive shaft.

The drive sheave 43 lifts the rope 15 up out of the well, through the wipers and then returns the rope back down into the well. The bottom end of the loop of rope is located inside of the well casing or tubing, and is submerged in the oil.

The bottom of the rope loop passes through the return sheave 49 (see FIG. 1). The return sheave 49 is rotatably mounted to a weight 117 that provides tension to the rope. The weight can be one or more sinker bars and typically ranges between 30 to 50 pounds.

Various methods can be used to determine the depth of the return sheave in a particular well. For example, in some wells, the return sheave can be located at a predetermined distance above the bottom of the well. Even if the well contains water, the rope can be located in the water. The rope itself, and the oil in the rope, tend to repel any water from adhering to the rope. In other wells, the return sheave may be located at some predetermined distance below the level of oil in the well. Other methods for locating the return sheave inside the oil can be used.

The rope 15 may have a tendency to twist, depending on the type of braid. If the rope twists, the return sheave is also likely to turn, thus twisting the loop. Several types of devices can be used to minimize twisting. In FIG. 10, there is shown a set of stabilizer clips 119. Each clip 119 is a leaf spring that has one end 121 coupled to the weight and the other end 123 free to slide. There are provided 2 to 4 clips around the circumference of the weight. The stabilizer clips 119 allow the return sheave to move up and down the casing 19, while minimizing any rotation of the return sheave 49 inside of the casing. In addition, the clips 119 maintain the return sheave 49 in a centered position inside of the casing 19 and away from the casing wall.

FIG. 11 shows another embodiment of an anti-twisting device. Rollers 125 are mounted to the weight 117. The rollers are free to rotate about an axis that is transverse to the casing. Thus, the return sheave can move up and down along the casing. Yet, the rollers resist any rotation of the return sheave inside of the casing. The rollers 125 are spring loaded, as shown in FIGS. 12A and 12B. The springs force the rollers radially outward, against the casing wall. If the rollers encounter a bump, then the rollers can roll over it.

Figure 14:
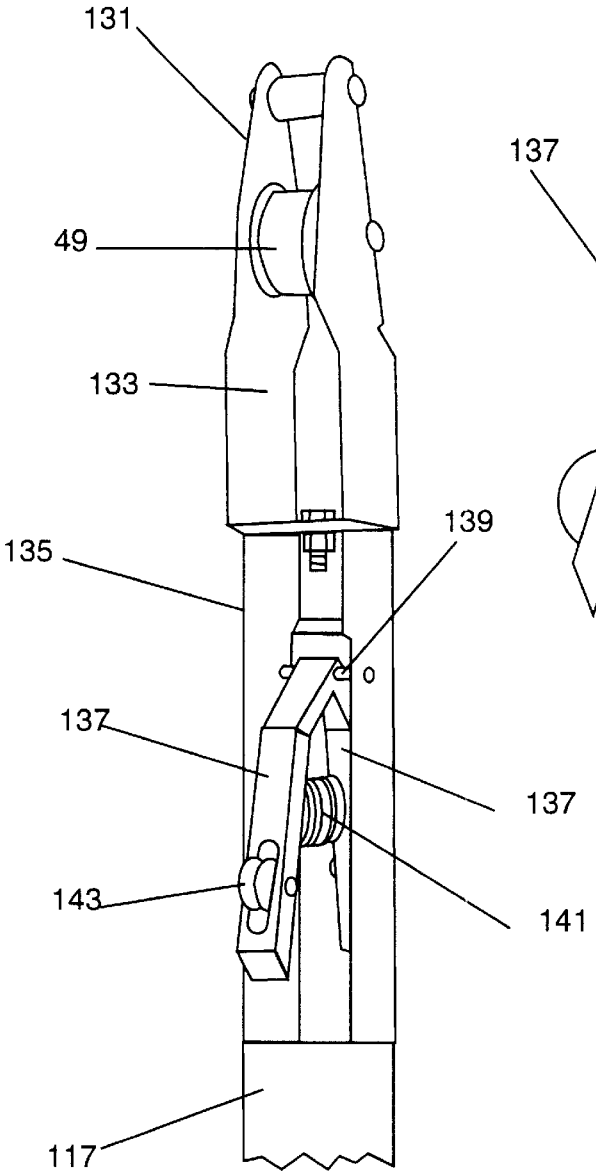
FIG. 14 is a schematic perspective view of the downhole sheave assembly, in accordance with still another embodiment.
Figure 15:
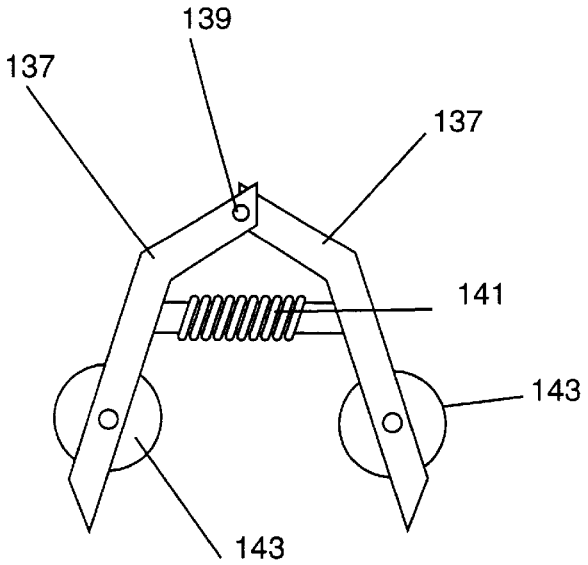
FIG. 15 is a schematic side view of the spring loaded arms of FIG. 14.
Figure 16:
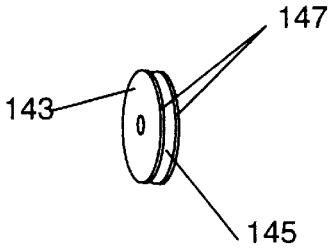
FIG. 16 is a view of one of the rollers of FIG. 14.

FIGS. 14–16 show still another embodiment of an anti-twisting device. The return sheave 49 is rotatably mounted inside of a bracket 131. Just below the return sheave, the bracket widens 133. This wider area allows the rope to move freely around the return sheave, without binding.

Coupled below the return sheave bracket is a lower bracket 135. The two brackets 131, 135 are coupled together so that if the lower bracket is fixed, the return sheave bracket will not rotate. Pivotally mounted inside of the lower bracket 135 is a pair of opposing arms 137 that extend longitudinally downward from a pin 139 or shaft. The arms 137 are forced radially outward by a spring 141. Mounted near the end of each arm is a roller 143. Each roller 143 is shaped like a sheave, having a circumferential groove 145 therearound. The groove creates edges 147 that penetrate into the scale and paraffin inside of the casing, and assist in preventing twisting of the return sheave inside of the casing. The rollers 143 allow the return sheave 49 to traverse up and down inside of the casing, but resist rotation about a longitudinal axis of the casing. The spring 141 forces the rollers 143 into the casing wall.

A weight 117 can be mounted below the lower bracket.

To load the device of FIG. 14 into a well, the arms 137 are forced together until they are inserted into the well casing. The arms are then released, wherein the arms expand radially outward to as to engage the rollers against the inside of the casing wall.

Before installing the lifting apparatus 11 into a well, it may be desirable to swab the well to clean the casing of paraffin, scale, etc. Such material inside of the casing could cause the rope to bind or chafe.

The operation of the lifting apparatus 11 will now be described, referring to FIGS. 1 and 2. The motor 47 rotates the drive sheave 43, which in turn pulls up the oily rope 15 from the well 13. The wipers 45 remove at least part of the oil from the rope, before the rope is returned to the well. The removed oil 17 falls down to the bottom of the housing 21 where it collects. The oil flows out through the drain 39 and into a pipe 41 to a holding tank, pipeline, etc. A booster pump can be provided to move the oil away from the well and into flow lines. A float switch with the float located inside of the housing can be used to activate the booster pump. When the level of oil inside of the housing reaches a certain depth, the booster pump is operated to empty the housing.

As the drive sheave rotates 43, its ridges 93 grab the rope and pull it. The deeper the rope is located in the groove 89, the greater the hold of the ridges on the rope. The deepness of the rope inside of the groove is determined by the stiffness of the rope, the rope diameter relative to the groove width, and the tension on the rope as applied by the downhole weight.

With the drive sheave 43, the rope need only be passed around the sheave for about a half turn. The sheave, which contacts both side of the rope, provides sufficient traction to grab onto the rope.

When the rope enters the drive sheave, the angled ridges draw the rope down into the groove. As the rope moves deeper into the groove, it becomes wedged inside of the groove, wherein the sheave can pull the rope up out of the well. After turning about 180 degrees, the rope exits the drive sheave. The angled ridges 93 assist in releasing the rope from the groove. There is also provided a stop projection 127 that is fixed to the housing side walls 25 and projects into the groove 89 downstream from where the rope should release from the drive sheave. If the rope continues to stick inside of the groove past the release point, the stop projection 127 peels the rope out of the groove.

In addition, the drive sheave 43 squeezes some oil out of the rope. This oil falls to the bottom of the housing.

The motor 47 can be operated continuously or intermittently. If well production does not warrant full time operation of the lifting apparatus 11, the apparatus can be operated periodically.

An advantage of the lifting apparatus 11 of the present invention is that very little water is produced. Conventional pumps utilizing sucker rods produce large amounts of water relative to oil. This presents separation problems, as well as disposal problems for the produced water. The produced water must be disposed of either by injection or by hauling away to another location. The apparatus of the present invention does not suffer from these problems.

As the rope wears (due to the wipers, the rollers, and the sheaves), fibers extend radially outward from its surface. These fibers increase the surface area of the rope and enhance the oil carrying capacity of the rope by as much as 20%.

The lifting apparatus 11 is compact, taking up less than 3–4 cubic feet and weighing only about 100 pounds. The housing can be sized according to the storage capacity that is desired. If more oil storage capacity is needed, a bigger housing can be used. The motor can be a single phase electrical motor, which can operate at a very low cost.

The foregoing disclosure and the showings made in the drawings are merely illustrative of the principles of this invention and are not to be interpreted in a limiting sense.

What is claimed is:

1. An apparatus for lifting fluid from a well; comprising:

a) a continuous loop of fibrous material, the loop being formed around a drive sheave and a return sheave;

b) the drive sheave having a groove with side surfaces that contact the fibrous material, the side surfaces being formed by ridges which are separated from one another by valleys, the ridges extending from a hub outwardly to an outside diameter of the drive sheave, at least some of the ridges from each inside surface contacting a portion of the fibrous material;

c) the return sheave being structured and arranged to be located inside of a well;

d) a motor coupled to the drive sheave so as to rotate the drive sheave;

e) at least one fluid remover located in contact with the fibrous material, the fluid remover removing oil from the fibrous material;

f) a container positioned so as to capture any fluid removed from the fibrous material by the remover.

2. The apparatus of claim 1, wherein the fibrous material is capable of maintaining a generally circular transverse cross-sectional shape and is capable of taking up a quantity of oil.

3. The apparatus of claim 1, wherein the loop comprises a rope made of plastic material.

4. The apparatus of claim 3, wherein the rope comprises a double braid.

5. The apparatus of claim 1, wherein the ridges of the drive sheave are angled with respect to a radius of the drive sheave, with a portion of each ridge at the outside diameter of the drive sheave leading the remainder of the respective ridge.

6. The apparatus of claim 1, wherein the groove has a width between the inside surfaces that tapers from the outside diameter of the drive sheave towards the center of the drive sheave.

7. The apparatus of claim 1, wherein the drive sheave comprises two transverse portions and at least one spacer that is interposed between the two portions, with the groove being sized so that a portion of the fibrous material can become wedged inside of the groove.

8. The apparatus of claim 1, wherein the fluid remover comprises a wiper that contacts an outside diameter of the fibrous material.

9. The apparatus of claim 8, wherein the wiper comprises a card with a slot for receiving a portion of the fibrous material therein.

10. The apparatus of claim 1, wherein:

a) the loop comprises a rope made of plastic material;

b) the ridges of the drive sheave are angled with respect to a radius of the drive sheave, with a portion of each ridge at the outside diameter of the drive sheave leading the remainder of the respective edge;

c) the groove has a width between the inside surfaces that tapers from the outside diameter of the drive sheave toward the center of the drive sheave;

d) the fluid remover comprises a wiper that contacts an outside diameter of the fibrous material;

e) the wiper comprises a card with a slot for receiving a portion of the fibrous material therein.

11. The apparatus of claim 1, wherein the return sheave is rotatably mounted to a support, the support having arms pivotally located thereon, which arms have rollers thereon, the rollers being structured and arranged to bear on an inside wall surface of the well, the arms being forced radially outward from the support.

12. The apparatus of claim 11, wherein the rollers have circumferential edges thereon.

13. The apparatus of claim 1 wherein the groove has a width between the inside surfaces that tapers from the outside diameter of the sheave towards the center of the sheave, the groove being sized so that a portion of the fibrous material can become wedged inside of the groove.

14. The apparatus of claim 1 wherein the ridges have rounded edges that are in contact with the portion of the fibrous material.

15. An apparatus for lifting fluid from a well, comprising:

a) a continuous loop of fibrous material, the loop being formed around a drive wheel and a return sheave;

b) a motor coupled to the drive wheel so as to rotate the drive wheel;

c) the return sheave being structured and arranged to be located inside of a well;

d) a wiper card having a slot therein, the card being mounted stationary with respect to the fibrous material, with the slot receiving a portion of the fibrous material, the slot having edges that bear against an outside surface of the fibrous material;

e) a container positioned so as to capture any fluid removed from the fibrous material by the card;

f) plural wiper cards, each of the cards being spaced apart from each other longitudinally along a length of the fibrous material, each of the cards contacting a different circumferential portion of the fibrous material.

16. The apparatus of claim 15, further comprising means for forcing the slot edges of the wiper card against the fibrous material.

17. The apparatus of claim 15, wherein the means for forcing the slot edges of the wiper card against the fibrous material further comprises a spring.

18. The apparatus of claim 15, wherein the wiper cards are located upstream from the drive wheel.

19. A method of lifting oil from a well, comprising the steps of:

a) providing a sheave with a groove therein, the groove being tapered from the outside diameter towards the center of the sheave, the groove having scalloped side surfaces:

b) locating a length of fibrous material in the well so as to make contact with the oil;

c) wedging a length of the fibrous material in the groove so that the fibrous material contacts the scalloped surfaces and pulling the fibrous material up out of the well with the sheave;

d) removing the oil from the fibrous material;

e) returning the fibrous material to the well.

20. The method of claim 19, wherein the step of locating a length of fibrous material further comprises the step of providing the fibrous material in a continuous loop around the sheave.

21. The method of claim 19, wherein the step of removing the oil from the fibrous material further comprises the step of wiping the oil from an outer surface of the fibrous material.

22. The method of claim 19, wherein:

a) the step of locating a length of fibrous material in the well further comprises the step of locating a length of rope in the well; and b) the step of removing the oil from the fibrous material further comprises the step of wiping the oil from an outer surface of the rope.

* * * * *